United States Patent [19]

Way, Sr. et al.

[11] Patent Number: 4,937,986

[45] Date of Patent: Jul. 3, 1990

[54] GUTTER PROTECTOR

[75] Inventors: Donald W. Way, Sr.; Royce L. Vail, both of Matthews; John P. Kieronski, Charlotte, all of N.C.

[73] Assignee: Ladon Enterprises, Matthews, N.C.

[21] Appl. No.: 379,095

[22] Filed: Jul. 13, 1989

[51] Int. Cl.[5] ..... E04D 13/00

[52] U.S. Cl. ..... 52/12; 210/474; 405/118

[58] Field of Search ..... 405/118–121; 52/11–16; 210/474, 475, 163, 162, 164

[56] References Cited

U.S. PATENT DOCUMENTS

| | | | |
|---|---|---|---|
| 2,209,741 | 7/1940 | Sullivan et al. | 210/474 |
| 2,674,961 | 4/1954 | Lake | 210/474 |
| 3,053,393 | 9/1962 | McLean | 405/120 X |
| 3,436,878 | 4/1969 | Singer . | |
| 3,950,951 | 4/1976 | Zukauskas | 405/119 |
| 4,261,143 | 4/1981 | Rizzo | 52/11 X |
| 4,308,696 | 1/1982 | Schroeder | 52/11 |
| 4,404,775 | 9/1983 | Demartini | 52/11 X |
| 4,497,146 | 2/1985 | Demartini | 52/11 X |
| 4,551,956 | 11/1986 | Axford . | |
| 4,592,174 | 6/1986 | Hileman . | |
| 4,727,689 | 3/1988 | Bosler . | |
| 4,745,710 | 5/1988 | Davis . | |
| 4,765,101 | 8/1988 | Wolf . | |
| 4,769,526 | 9/1988 | Taouil | 52/11 X |
| 4,769,957 | 9/1988 | Knowles . | |

*Primary Examiner*—Dennis L. Taylor

*Attorney, Agent, or Firm*—Shefte, Pinckney & Sawyer

[57] ABSTRACT

A gutter protector adapted for mounting on a sloping shingled roof for attachment under the next-to-last row of shingles and extending at an inclination to the roof with perforations for flow of water through the gutter protector directly into the gutter and onto the roof and into the gutter. There are a series of alternating perforated sections and imperforate sections that are relatively inclined to cause change of direction of flow to facilitate flow of water through the perforations and to facilitate lifting and washing of leaves and debris from section to section and off the gutter protector away from the roof. An outer end portion extends upwardly from the gutter to obstruct view of the other sections from ground level.

12 Claims, 3 Drawing Sheets

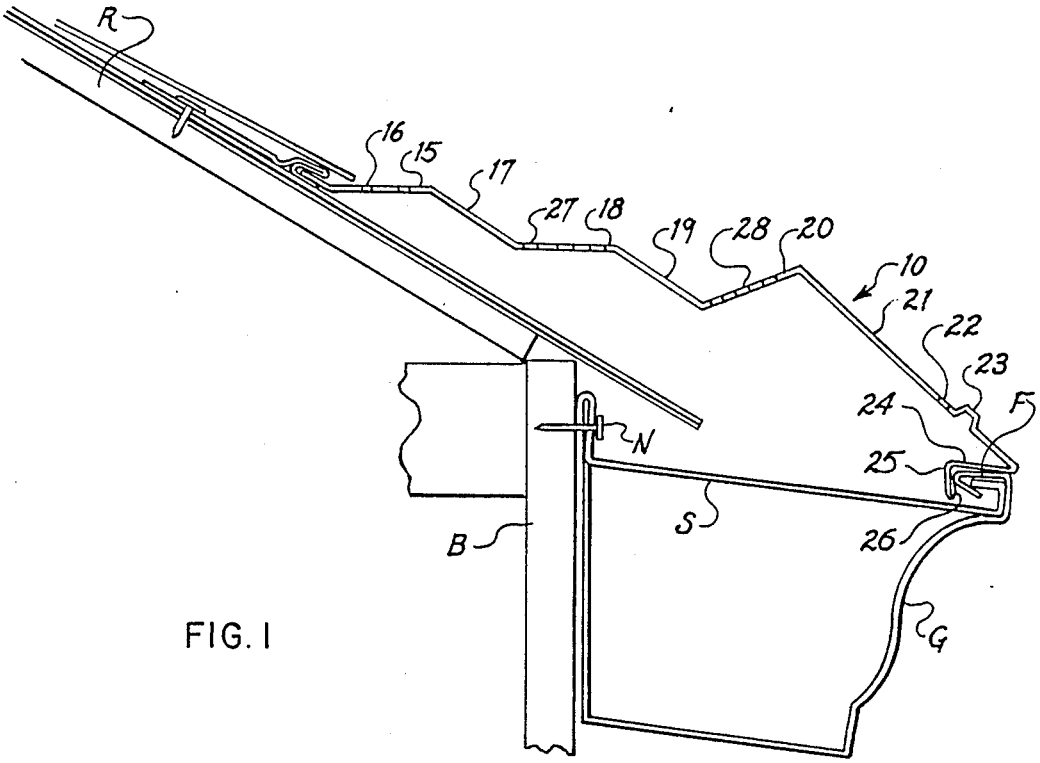
FIG. 1
FIG. 2
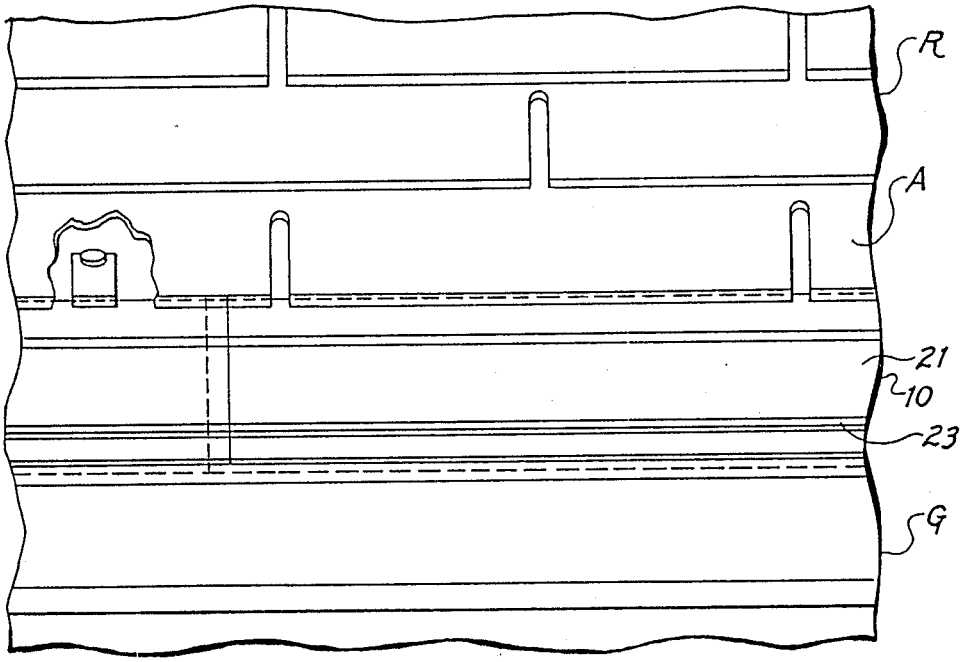

FIG. 3
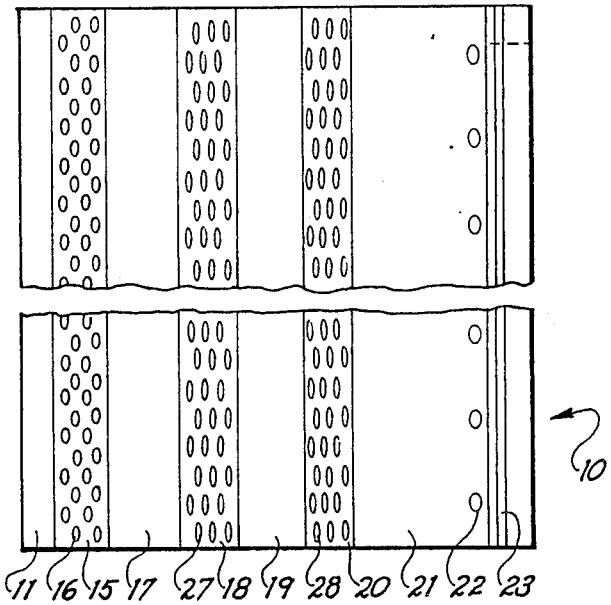
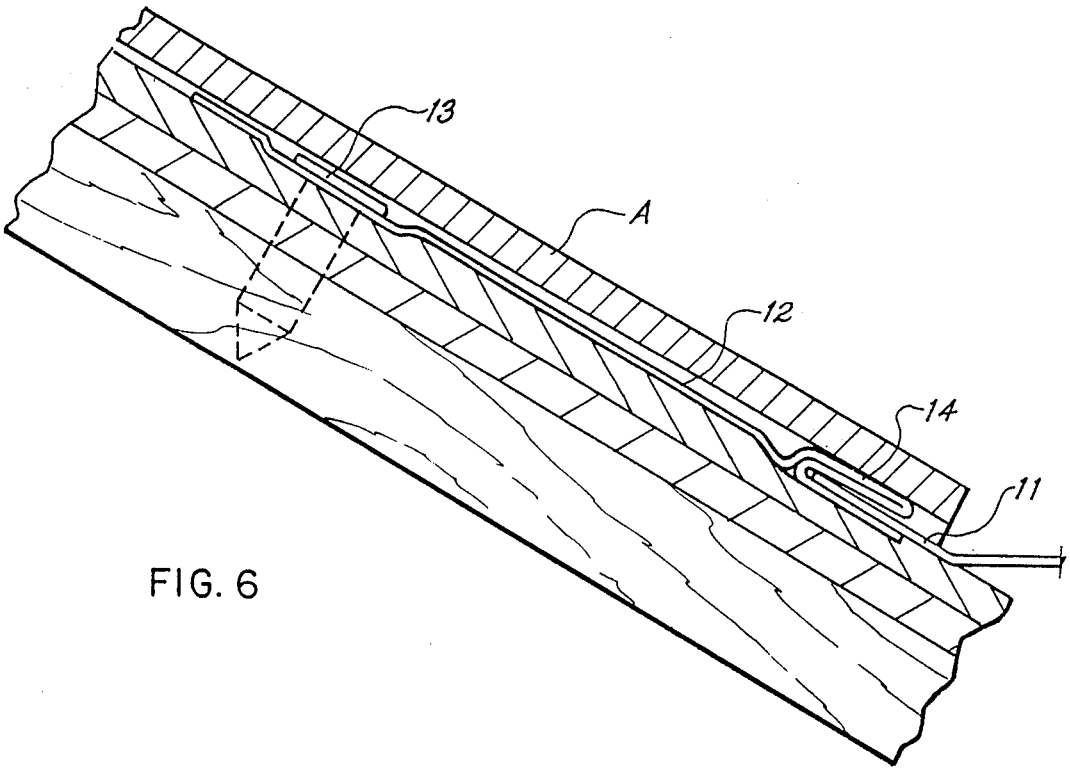
FIG. 6

GUTTER PROTECTOR

BACKGROUND OF THE INVENTION

The present invention relates to a gutter protector and particularly to a gutter protector adapted for mounting over a gutter on a sloping shingle roof.

Roof gutters have been subjected to the problem of interference with proper drainage by accumulation of leaves and other debris for as long as they have been in use. Various attempts have been made to keep leaves and other debris from accumulating in the gutters with only limited success and often with some interference in effective draining of water into the gutters. For example, flat perforated gutter covers are disclosed in U.S. Pat. Nos. 3,436,878; 3,950,951; 4,727,689; 4,745,710; 4,765,101; and 4,769,957. All of these covers extend at a slight downward inclination over the top of the gutter in a manner which does prevent most leaves and debris from entering into the gutter, but do not effectively prevent some accumulation of leaves and debris on the cover blocking the passage of water into the gutter and thereby interfering with the purpose of the gutter itself.

In U.S. Pat. No. 4,592,174, a gutter protector is shown having an upstanding perforated back wall facing the roof and projecting above the adjacent level of the roof. This provides for effective drainage while preventing leaves and debris from entering the gutter, but only until there is an accumulation of leaves and debris against the wall sufficient to block drainage of water through the perforations of the wall and such accumulation remains to cause water to be retained at the back side of the gutter between the gutter and the building wall, causing further problems.

In U.S. Pat. No. 4,551,956, a compound gutter construction is disclosed in which a shallow gutter is mounted on top of an inner gutter with the shallow gutter preventing entry of leaves and debris into the inner gutter. While the shallow gutter does not accumulate leaves and debris to the same extent as a conventional deep gutter, there is leaf and debris accumulation to some extent and the shallow gutter is not as effective as a deep gutter in preventing rain water from falling off the edge of the roof during heavy rains.

In contrast, the present invention provides a gutter protector that not only prevents entry and accumulation of leaves and other large size debris in the gutter but, while doing so, provides for entry of substantially all of the draining water into the gutter with the draining water effectively washing the leaves and other similar debris off the gutter protector out of interference with proper draining.

SUMMARY OF THE INVENTION

Briefly described, the present invention provides a gutter protector adapted for mounting on a sloping roof of the type having shingles arranged in horizontally extending overlapping rows. The gutter protector has an inner edge portion that is positionable under a row of shingles that is upward of the lowermost row of shingles. A draining surface portion extends from the inner edge portion at an inclination with respect to the slope of the roof for extension at a spacing above the last row of shingles and above the gutter. This draining surface portion has perforations for draining water therethrough into the gutter without passage of leaves and other large debris therethrough. An outer end portion extends from the draining surface portion for engagement with the outer edge of the gutter. With this arrangement, an extended draining surface can be provided in comparison with a gutter protector that extends only over the gutter itself and the inclination of the draining surface with respect to the roof allows draining along this extended surface. For this purpose, the perforations in the draining surface portion are preferably located for disposition over both the gutter and the last row of shingles for draining of water directly into the gutter and also onto the last row of shingles and therefrom into the gutter.

Preferably, the draining surface portion includes a plurality of longitudinally extending sections at least one of which is imperforate and at least another of which extends outwardly therefrom at an inclination with respect thereto and has perforations therein. The relative inclination of the sections causes the flow of water flowing from the imperforate section over the perforated section to wash leaves and other debris off the perforated section and off the outer end portion away from the gutter. In the preferred embodiment, the outwardmost perforated section extends at an inclination to horizontal to provide resistance to flow of water thereover to facilitate flow of water through the perforations and to facilitate washing of leaves and debris therefrom. Also, in the preferred embodiment, there are two imperforate sections and three perforated sections with the two innermost perforated sections extending at a lesser inclination to the imperforate sections than the inclination of the outermost of the perforated sections.

Preferably, the outer end portion extends at a downward inclination from the draining surface portion and has an outer edge engagable with the outer edge of the gutter. In the preferred embodiment, the outer end portion extends upwardly from the gutter sufficiently to substantially obstruct sight of the draining surface portion from ground level when the gutter guard is installed on a roof and gutter. This outer end portion preferably extends from the draining surface portion without substantial obstruction to washing of leaves and debris therefrom. To allow water to pass through the outer end portion into the gutter, including rain water falling on the outer end portion, perforations are provided in the outer end portion adjacent its outer edge. Preferably, flow of water through the perforations is facilitated by having a longitudinally extending upwardly inclined section formed in the outer end portion below the perforations to provide resistance to flow of water therepast so that the water will flow through the perforations. In the preferred embodiment, the upwardly inclined section is in the form of an upwardly projecting rib.

With the foregoing construction, the gutter protector of the present invention provides efficient and effective draining of water into the gutter while preventing accumulation of debris in the gutter and is constructed in a way to obviate any unsightly appearance.

BRIEF DESCRIPTION OF THE DRAWINGS

FIG. 1 is a vertical section of the outer portion of a roof showing a conventional gutter and a gutter protector according to the preferred embodiment of the present invention;

FIG. 2 is a front elevation of the roof portion, gutter and gutter protector of FIG. 1;

FIG. 3 is a plan view of the gutter protector of FIG. 1;

FIG. 6 is an enlargement of the portion of FIG. 1 at the connection of the gutter protector to the roof.

DETAILED DESCRIPTION OF THE PREFERRED EMBODIMENT

Figure 4:
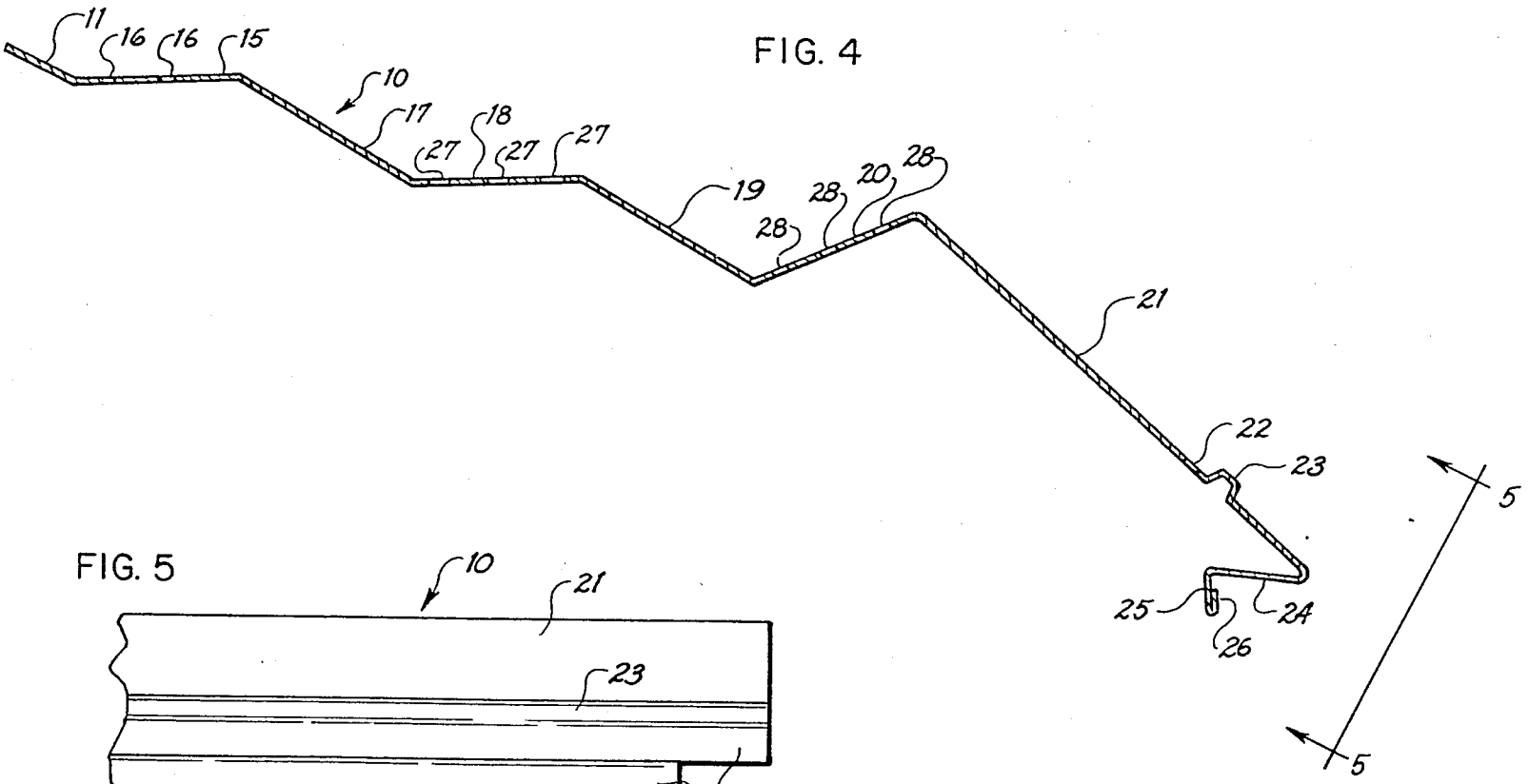
FIG. 4 is an enlarged vertical section of the gutter protector of FIG. 3.

Referring to the drawings, the gutter protector 10 of the preferred embodiment of present invention is illustrated mounted on a conventional shingled sloping roof R on a building structure B in conjunction with a conventional gutter G that is attached to the building structure B in any conventional manner, such as by nails N and supported by brackets S or by any other suitable means.

The shingles A of the roof are arranged in horizontally extending rows and the gutter protector 10 has an inner edge portion 11 that is positioned under the second row of shingles A from the bottom, which is the row upward of the lowermost row of shingles. The inner edge portion 11 of the gutter protector 10 is secured under the shingles in spaced brackets 12 that are attached to the roof by nails 13. The brackets 12 are formed of sheet metal that is bent to form a downwardly facing U-shaped portion 14 in which the edge of the inner edge portion 11 is received. The brackets 12 are nailed in place by lifting the shingles and then driving the nails through the bracket and the underlying shingle into the frame without disturbing the outer shingle. The inner edge portion 11 is imperforate and extends substantially completely under the shingles. It is inclined to conform to the slope of the roof by bending at its juncture with the adjacent portion of the gutter guard 10, which bending may be facilitated by scoring the metal of the gutter protector along the juncture line.

Extending from the inner edge portion 11 is a multi-section draining surface portion 15, 17, 18, 19 and 20. This draining surface portion extends at an inclination with respect to the slope of the roof for extension at a spacing above the last row of shingles and above the gutter. This inclination may be varied as desired from an inclination that may be downward from the horizontal to an inclination upwardly from the horizontal. The inclination should be sufficient to provide a spacing from the roof to allow water to drain through the gutter guard onto the roof and into the gutter and it should otherwise not be inclined substantially downwardly sufficient to result in a rapid flow of water over the surface without draining through the perforations 16, 27 and 28 formed therein. On the other hand, the inclination should not be sufficiently above horizontal to prevent washing of leaves and other debris outwardly off the surface rather than accumulating on the surface and obstructing drainage. A suitable inclination can be selected based on experience and conditions.

Extending from the draining surface portion 15, 17, 18, 19 and 20 is an outer end portion 21 that extends for engagement with the outer flange F of the gutter G. This outer end portion 21 extends at a downward inclination from the draining surface portion and has an outer edge engagable with the outer edge of the gutter. For this purpose, the outer edge is bent inwardly to form a generally horizontal strip 24 for seating on the top of the outer flange F of the gutter G. The inner end of the strip 24 is bent downwardly at a slightly forward inclination to form a latching strip 25 that latches over the inner edge of the gutter flange F. The end of the latching strip 25 is bent upwardly on itself as at 26 to facilitate latching, for strengthening, and to eliminate a sharp cut outer edge. The gutter protector 10 is dimensioned in relation to the distance between the brackets 12 and the gutter flange F so that when the inner edge portion 11 is seated in the brackets 12 there is a slight flexing of the gutter protector 10 tensioning the latching strip 25 in position against the gutter flange F, with the flexing resulting in a firm latching of the gutter protector 10 in place.

As seen from the figures, the outer end portion 21 extends upwardly from the gutter flange F sufficiently to substantially obstruct sight of the draining surface portion from ground level when the gutter protector is installed on a roof and gutter. The outer end portion 21 extends without substantial obstruction to washing of leaves and debris from the draining surface portion onto the outer end portion and therefrom away from the gutter. However, it does include perforations 22 adjacent its outer edge for passage of water, including rain water falling on the outer end portion 21, therethrough into the gutter G. To provide resistance to flow of water past the perforations 22 and, thereby, to facilitate flow of water through the perforations 22, the outer end portion 21 is formed with a longitudinally extending upwardly inclined section below the perforations 22. In the embodiment illustrated, this upwardly inclined section is in the form of an upwardly projecting rib 23.

As mentioned above, the draining surface portion 15, 17, 18, 19 and 20 extends over and above the last row of shingles for draining of water directly into the gutter and also onto the last row of shingles and therefrom into the gutter. For this purpose, the draining surface portion is formed with a plurality of sections. In the preferred embodiment illustrated, there are five longitudinally extending sections of alternating perforated sections 16, 27 and 28 and imperforate sections 17 and 18. The first perforated section 15 has a series of perforations 16 for draining of water therethrough. This first section 15 extends from the inner edge portion 11 at an inclination thereto to provide a spacing of the section from the shingle therebelow so that flow of water can pass through the section onto the shingle and then down into the gutter G. The inclination of this first section 15 is an inclination relative to the roof. It may, as desired, be actually horizontal or even slightly inclined downwardly from horizontal as well as inclined slightly above horizontal. The selection of the particular inclination is made in consideration of the desired spacing from the shingle, resistance to such rapid flow of water thereover that the water would not tend to flow through the perforations 16, while not being sufficiently inclined to prevent washing of leaves and other debris off the surface. The inclination with respect to the slope of the roof facilitates washing by the water of leaves and other debris off the section as the water tends to wash under the leaves and debris in a lifting action as it changes direction from the slope of the roof to the inclination of the perforated section 15.

Extending at a downward inclination from the first perforated section 15 is an imperforate section 17 that allows the first perforated section 15 to be relatively narrow to facilitate washing of leaves and debris therefrom and also provides a change of direction for an overall inclination of the total draining surface portion. Also, importantly, the first imperforate section 17 extends at a downward inclination to the second perforated section 18, which extends at an upward inclination relative to the first imperforate section 17 so that water flowing down the first imperforate section will change direction as it flows onto the second perforated section, which change of direction facilitates washing of leaves and debris from the second perforated section and also provides some resistance to flow to facilitate flow of water through the perforations 27 of the second perforated portion. The inclination of the second perforated section 18 may be the same as that of the first perforated section or may be varied within the same considerations as mentioned above for the inclination of the first perforated section 15. The second perforated section 18 has perforations 27 of suitable size and arranged in a suitable pattern. Outwardly of the second perforated section 18 is a second imperforate section 19 that extends at a downward inclination from the second perforated section 18 in a manner similar to the extension of the first imperforate section 17, and serves the same purpose with respect to a third perforated section 20 that extends at an upward inclination from the outer end of the second imperforate section 19 and has perforations 28 through which water flows into the gutter G therebelow. The third perforated section 20 has perforations 28 of suitable size and arranged in a suitable pattern. The inclination of the third perforated portion 20 may be selected with the same considerations as the selection of the inclination of the first and second perforated sections 15 and 18, although in the preferred embodiment illustrated the third perforated section is at a greater inclination than the other two perforated sections to provide somewhat greater obstruction to flow of water therepast and a greater change of direction to facilitate lifting and washing of leaves and debris therefrom. The greater inclination also results in an elevation of its outer end to provide sufficient extent of the outer end portion 21 to obstruct sight of the draining surface portions 15, 17, 18, 19 and 20 from ground level.

It should be noted, that the junctures of the various sections and the juncture of the outermost section 20 with the outer end portion 21 are unobstructed to flow of leaves and debris therepast so that the washing of leaves and debris will not be impeded.

In a typical construction, the first perforated section 15 is inclined at approximately 30° to the slope of a roof, which itself may be 30°, resulting in the first perforated section 15 extending generally horizontally. The first imperforate section 17 extends at a downward inclination from horizontal of approximately 5° and the second perforated section 18 extends at about 35° from the first imperforate section 17, resulting in the second perforated section 18 extending generally horizontally. The second imperforate section 19 also extends downwardly from horizontal about 5° and the third perforated section 20 is inclined upwardly from the second imperforate section 19 about 55°, which results in the third perforated section 20 being inclined from horizontal at an upward inclination outwardly of approximately 20°. The outer end portion 21 extends downwardly from the third perforated section 21 at a downward inclination of approximately 25°. As mentioned above, the particular inclination of the various portions and sections may be varied as desired to obtain suitable results in a particular installation and under particular conditions of use.

The perforations 16 in the first perforated section 15 are approximately ⅛" in diameter and arranged in four staggered rows with the perforations 16 in each row being spaced apart approximately ½" center-to-center. The perforations 27 in the second perforated section 18 and the perforations 28 in the third perforated section 20 are approximately 3/16" in diameter and arranged in six staggered rows with the perforations 27, 28 in each row being spaced apart approximately ¾" center-to-center. The perforations 22 in the outer end portion 21 are approximately ⅛" in diameter and at a spacing of approximately 1½" center-to-center. The size and spacing of the perforations 16, 27, 28 and 22 may be varied as desired to best suit conditions.

Figure 5:
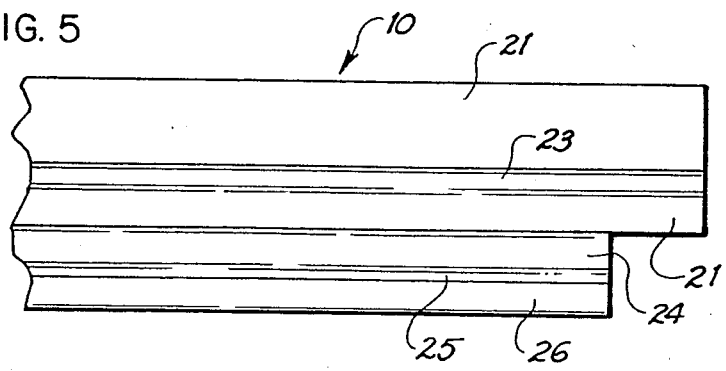
FIG. 5 is a partial view of an end of a section of the gutter protector of FIG. 4 as viewed along line 5-5 of FIG. 4.

The gutter protector 10 as described above can be easily formed in longitudinal sections of any convenient length. The sections can then be assembled on a gutter with adjacent ends overlapping. To assure a flush overlapping, one end of each section has the inturned horizontal strip 24 and latching strip 25 notched out to the extend of the overlap, as seen in FIG. 5.

With the construction as described above, the gutter protector 10 provides an effective and efficient protector for a gutter preventing leaves and other similar debris from entering and clogging the gutter while providing for substantially complete draining of water from the roof into the gutter. Also, the extent of the outer surface portion 21 aesthetically tends to hide the lines of the other surface portions from view of a ground level observer.

The use of brackets 12 as described above for attachment of the gutter protector to a roof is presently preferred, but other attaching means, such as adhesives, could be used as well.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A gutter protector adapted for mounting on a sloping roof of the type having shingles arranged in horizontally extending overlapping rows, comprising:

an inner edge portion that is positionable under a row of shingles that is upward of the lowermost row of shingles;

a draining surface portion extending from said inner edge portion at an inclination with respect to the slope of the roof for extension at a spacing above the last row of shingles and above the gutter, said draining surface portion having perforations for draining water therethrough into the gutter without passage of leaves and other large debris therethrough; and an outer end portion extending from said draining surface portion for engagement with the outer edge of the gutter;

said draining surface portion comprises a plurality of longitudinally extending sections at least one of which is imperforate and at least another of which extends outwardly therefrom at an inclination with respect thereto and has perforations therein, the relative inclination causing the flow of water flowing from said one section over said another section to wash leaves and other debris outwardly off said another section and off said outer end portion away from the gutter.

2. A gutter protector according to claim 1 and characterized further in that the perforations in said draining surface portion are located for disposition over the gutter and over the last row of shingles for draining of water directly into the gutter and also onto the last row of shingles and therefrom into the gutter.

3. A gutter protector according to claim 1 and characterized further in that said another section extends from said one section at an inclination to horizontal to provide resistance to flow of water thereover to facilitate flow of water through the perforations and to facilitate washing of leaves and debris therefrom.

4. A gutter protector according to claim 1 and characterized further in that there are at least two of said imperforate sections and at least two of said sections having perforations, said sections having perforations alternating outwardly with said imperforate sections.

5. A gutter protector according to claim 4 and characterized further in that the outermost of said sections having perforations extends outwardly at an inclination to horizontal to provide resistance to flow of water thereover to facilitate flow of water through the perforations and to facilitate washing of leaves and debris therefrom.

6. A gutter protector according to claim 5 and characterized further in that there are two of said imperforate sections and three of said sections having perforations with the two innermost of said sections that have perforations extending at a lesser inclination to said imperforate sections than the inclination of said outermost of said sections having perforations.

7. A gutter protector according to claim 1 and characterized further in that said outer end portion extends at a downward inclination from said draining surface portion and has an outer edge engagable with the outer edge of the gutter.

8. A gutter protector according to claim 7 and characterized further in that said outer end portion extends upwardly from the gutter sufficiently to substantially obstruct sight of said draining surface portion from ground level when said gutter protector is installed on a roof and gutter.

9. A gutter protector according to claim 7 and characterized further in that said outer end portion extend from said draining surface portion without substantial obstruction to washing of leaves and debris from said draining surface portion onto said outer end portion and therefrom away from the gutter.

10. A gutter protector according to claim 7 and characterized further in that said outer end portion has perforations adjacent its outer edge for passage of water, including rain water falling on said outer end portion, therethrough into the gutter.

11. A gutter protector according to claim 10 and characterized further in that said outer end portion has a longitudinally extending upwardly inclined section below said perforations to provide resistance to flow of water therepast and facilitate flow of water through said perforations.

12. A gutter protector according to claim 11 and characterized further in that said upwardly inclined section of said outer end portion is in the form of an upwardly projecting rib.

* * * * *